United States Patent [19]

Kambic

[11] 4,334,388

[45] Jun. 15, 1982

[54] DOOR POSITION MONITORING ASSEMBLY

[75] Inventor: Raymond V. Kambic, Joiliet, Ill.

[73] Assignee: Brink's Locking Systems, Inc., Plainfield, Ill.

[21] Appl. No.: 179,265

[22] Filed: Aug. 18, 1980

[51] Int. Cl.[3] ..... G08B 13/08

[52] U.S. Cl. ..... 49/14; 49/13; 49/24

[58] Field of Search ..... 49/13, 14, 15, 24

[56] References Cited

U.S. PATENT DOCUMENTS

| | | | |
|---|---|---|---|
| 1,531,107 | 3/1925 | Larson | 49/14 X |
| 1,604,209 | 10/1926 | Wenzel | 49/14 X |
| 3,426,478 | 2/1969 | Sturges et al. | 49/24 X |
| 3,728,057 | 4/1973 | Grundmann et al. | 49/13 X |
| 3,832,804 | 9/1974 | Goldsmith | 49/13 |
| 3,973,357 | 8/1976 | Kluempers | 49/13 |

OTHER PUBLICATIONS

Folger Adam Catalogue page, relating to "Door Position Indicator Switch", Model No. 524–copy attached.

*Primary Examiner*—Kenneth Downey
*Attorney, Agent, or Firm*—Trexler, Bushnell & Wolters, Ltd.

[57] ABSTRACT

There is disclosed an improved door position monitoring unit for use in a security door installation. The unit includes track means for mounting with respect to a horizontal edge of a door and movable therewith, a circuit component such as a switch mounted with respect to a stationary surface of the door installation, such as the door frame or the threshold. The circuit component is capable of being operated to attain a first condition, and a second condition which conditions can be detected by suitable circuit means. A control arm is provided to mechanically link the door to the switches, said control arm having one end thereof slidably connected to said track means, and being pivotally mounted proximate the other end thereof to the door frame, such that movement of said door will produce pivotal movement of said control arm. Actuator means are provided interconnecting the pivotally mounted end of the control arm and the circuit component such that when the door is open said circuit component will be in a first condition, with rotation of said control arm upon movement of the door to the substantially closed position, producing a second condition for said circuit component, with initial movement of the door away from the fully closed position producing pivotal movement of the control arm in an opposite direction permitting said circuit component to return to said first condition.

27 Claims, 9 Drawing Figures

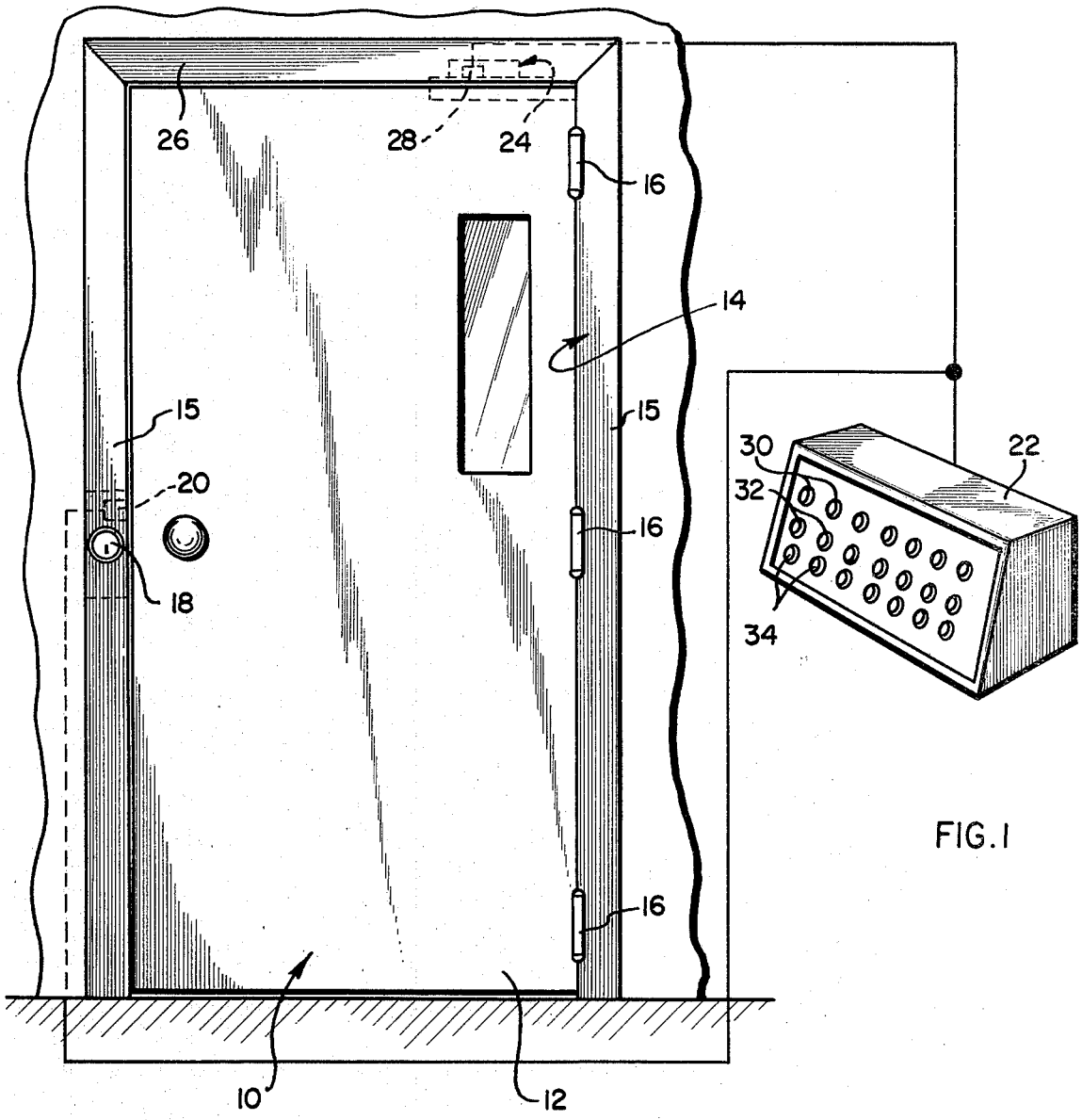
FIG. 1
FIG. 2
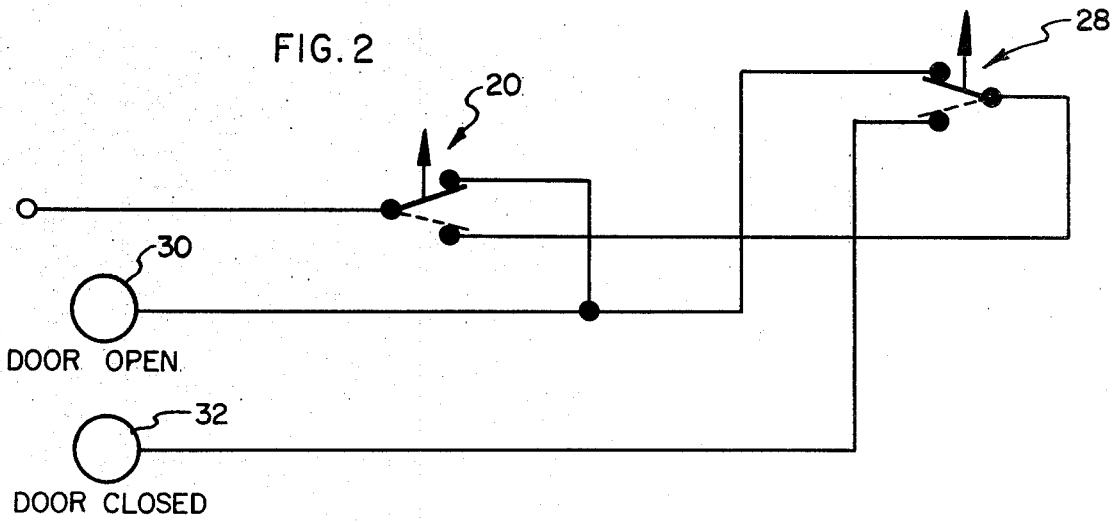

DOOR POSITION MONITORING ASSEMBLY

BACKGROUND OF THE INVENTION

The present invention relates to a monitored, controlled door installation, such as the type employed in penal institutions and more specifically, to an improved door position monitoring arrangement.

Modern penal institutions of the medium to high security type employ sophisticated monitoring and control apparatus for cell doors. This is done to provide security for the guards, as well as the individual inmates, as it is necessary to control door operations so as to permit only one or possibly a few doors to be opened at any time. In one type of system, the doors are controlled electrically from a remotely located control panel. The correction officer will have a master key which can mechanically unlock any door in a group, with each inmate being issued an individual key capable of permitting the unlocking of his cell door from the exterior of the cell. Inside the cell, a push-button is provided which can operate the cell lock enabling the prisoner to exit the cell. The ability of the prisoner to operate the door from the interior of the cell is controlled by a main control panel, and as such each cell door lock can be rendered operable or inoperable at the election of the correction officer. Accordingly, when it is desired to control the number of inmates who have exited their cells at any one time it becomes extremely important that the control panel provide the correction officer with a correct indication as to the status of the various cell doors in the group under his control. To attain the desired monitoring of the status of the cell door, various types of apparatus are used, which are responsive to door position and capable of providing a control signal in relation thereto.

More specifically, the cell door lock mechanism generally includes a monitoring switch which is operated from a first door-open position to a second, door-closed position when the door is fully closed. When the door is open or ajar slightly, however, these switches and the lock mechanism are accessible and can be easily operated manually by an inmate to give a false signal that the door is closed and locked, when in fact it is not. To augment this type of lock monitoring arrangement it is a relatively common practice to employ a second door positioning monitor that cannot be easily circumvented by the inmate. The respective door positioning monitors are connected in series with a control panel so that a "door secure" signal is provided only when both monitoring units detect the closed position for the door. As such, ideally the second monitoring arrangement should be of a type that will give the "door secure" signal only when the door is approximately at the fully, and completely closed position. In this condition, the engagement of the door with the door stop and its alignment with the door jamb preclude the inmate from manually overriding the lock apparatus and the monitoring switch associated therewith.

One type of known secondary or supplemental monitoring arrangement employed in the art employs a switch which is associated with a hinge-type actuator, and is operated as a result of the pivotal movement of the door about the axis provided by the door hinges. The problem with this arrangement, however, is that the sensitivity of available switch designs is such that a certain minimum amount of movement of the operating arm for the switch is required before the switch is operated from one condition to another. Since the operational movement for the switch is produced as a result of the pivotal movement of the door, there exists with these prior art arrangements, a certain play or range of arcuate movement of the door that can take place when the door is moved from the closed to the partially opened or ajar position, before the switch is actuated. By way of example, assuming a two foot wide door, two degrees (2°) of movement of the door will result in 11/16 inches of movement of the free edge of the door at the door jamb proximate the lock; correspondingly, three degrees (3°) of movement will result in 1¼ inches of opening at the jamb. Openings of this size can be sufficient to enable an inmate to override the lock and the monitoring switch associated therewith so that the control panel may register a "door secure" condition when in fact a door is ajar and not secured.

The present invention provides an improved door positioning monitoring arrangement which attains increased sensitivity of operation through the arrangement and construction of the various elements of the overall assembly, while using conventional switch components. More specifically, with the prior art type of monitoring arrangements as discussed above, the ratio of door movement to movement available for operation of the monitoring switch was 1:1; that is, one degree (1°) of door movement produced but one degree (1°) of rotational movement about the hinge axis for transmittal to the switch actuating mechanism. As will be explained more fully hereinafter with regard to the drawings and the detailed description of the disclosed embodiment, with the present invention increased sensitivity is attained such that the ratio of movement available for switch operation to door movement is greater than 1:1. Basically, this result is attained by moving the operational pivot for the switch actuating mechanism away from the pivotal axis of the door as defined by the hinges, and by connecting the pivotally mounted door to said actuating mechanism by a control arm which is slidably connected to the door, yet will pivot relative to the switch actuating mechanism. With the present arrangement, it has been found that considerable improvement in the monitor sensitivity can be attained. As will be detailed more fully in conjunction with the detailed description of the illustrated embodiment, a ratio of actuator movement to door movement of 1.55:1 is easily attained. Thus, by way of example, with the prior art two degrees (2°) of door travel will result in only two degrees (2°) of rotational movement at the hinge axis, with the present invention, as illustrated, approximately three degrees—five minutes (3°–5′) of actuator movement is obtained.

Numerous other advantages and features of the invention will be apparent from the description of the drawings and the detailed discussion of the preferred embodiment illustrated therein which follow.

DESCRIPTION OF THE DRAWINGS

FIG. 1 is a schematic view of a security door installation embodying the present invention;

FIG. 2 is an electrical schematic of the arrangement of the monitoring switches used at the lock and adjacent the door header;

DESCRIPTION OF THE ILLUSTRATED EMBODIMENT

Figure 5:
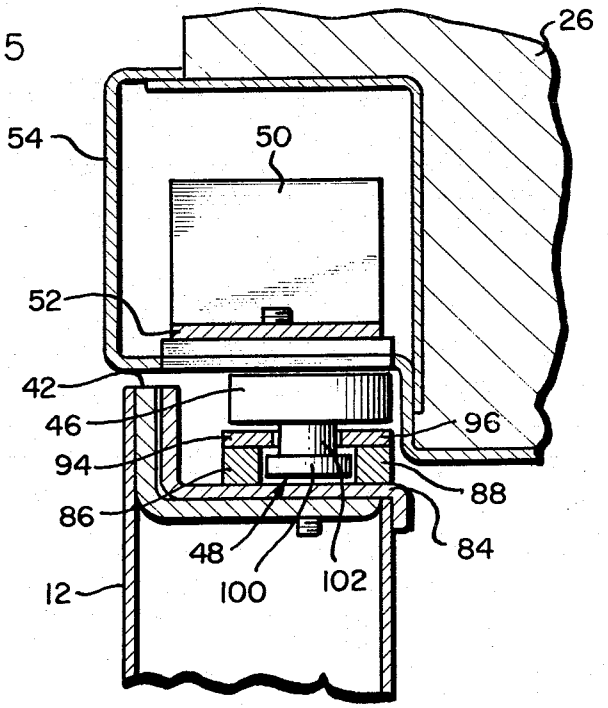
FIG. 5 is a sectional view through the arrangement of the present invention, illustrating the manner in which the pivot arm is connected to the track means.

The present invention provides an improved door positioning monitoring arrangement which attains increased sensitivity of operation through the arrangement and construction of the various elements of the unit, while using conventional switch components. More specifically, with the prior art type of monitoring arrangements used to augment the switch mounted monitor, as discussed above, the ratio of door movement to operational movement for the switch was 1:1, that is, one degree (1°) of door movement produces but one degree (1°) of rotational movement about the hinge pivot axis. As will be explained more fully hereinafter, the present invention with its increased sensitivity, the ratio of operational movement to door movement available for transmittal to the switch is far in excess of 1:1.

Referring initially to FIGS. 1 and 2, a typical security door installation is illustrated, the overall installation being designated generally 10. In the illustrated embodiment 10, there is provided a door 12, a door frame 14, and hinges 16 which pivotally attach the door to one of the jambs 17 of the door frame. Mounted in the opposite jamb 15 is an electrically controlled lock assembly 18 which can be key operated from the exterior of the cell, and is electrically controlled from the interior of the cell by a button or switch mounted within the cell. The purpose for this arrangement will become clear from the discussion to follow.

The lock assembly 18 includes a monitoring switch, shown in FIG. 1, and designated 20, in FIG. 2. The switch 20 is normally biased to the condition as illustrated in full line, i.e. the door open condition, and is operated by the door 12 to the position illustrated in dotted line i.e. the door-closed condition. The lock assembly 18, which may be of one of a number of known constructions but preferably is of the type illustrated generally in applicant's co-pending application Ser. No. 876,685. The lock 18 includes the monitoring switch 20, both being connected to a control panel 22 along with a secondary or supplemental door positioning monitoring unit 24. The secondary or supplementary door position monitoring unit 24 is mounted in the header 26 of the door frame 14, as illustrated in dotted outline in FIG. 1. The construction of this assembly will be discussed in greater detail hereinafter with respect to FIGS. 3–8, however for purposes of the present discussion, it should be noted that the unit 24 includes a circuit component in the form of a switch 28 responsive to movement of the door to and from the fully closed position.

Looking to FIG. 2 in conjunction with FIG. 1, FIG. 2 is a partial schematic view of the wiring of switches 20 and 28 with respect to the control panel 22. The aforementioned control panel includes a first series of indicator lights or lamps 30, one for each cell being monitored, which lamps 30 when energized will indicate that the cell door 12 is open. Correspondingly, a second series of lights 32 are provided for indicating the door closed position for cell door 12. Immediately below each set of lamps or lights 30 and 32 is a push-button switch 34 which is wired with the lock assembly 18 for a particular cell in a well known manner, such that when the push-button switch is operated by the correctional officer, the lock mechanism 18 will be rendered operational by the push-button switch (not shown) located interiorly of the cell.

With reference to FIG. 2, it can be seen that the switches 20 and 28 for a particular cell are wired essentially in series with the corresponding lamp 32, with said switch normally biased to the full line position shown, and operated to the positions indicated in dotted line by the door 12. It should be noted that before the door-closed lamp 32 will be energized, both switches 20 and 28 must be in the positions shown in dotted line. Should an inmate attempt to manually operate switch 20, with the door slightly ajar, switch 28 will remain in the position shown in full line to energize the door-open indicator lamp 30.

Thus, it can be appreciated that the sensitivity of the secondary door position monitor 24 is all important to the effective operation of the overall security system. In this regard, the secondary unit 24 must not operate the switch 28 to the door-closed position (dotted line) until the door is essentially fully closed or within less than two degrees (2°) of the door closed position. If operation occurs sooner, an inmate can override the system. As will be discussed the door monitoring unit 24 of the present invention provides the necessary sensitivity to insure that the system cannot be overriden manually.

Looking to FIGS. 3–8, the construction of the monitoring unit 24 will first be considered, and then the operation of this unit 24 will be discussed. With regard to the overall construction, attention is first directed to FIG. 3, where it will be noted that the upper edge 42 of the door 12 has been recessed or mortised and a track assembly 45 disposed therein. A control arm 46 is provided and is slidably connected to the track 45 by a pin member 48, of unique design which enables the door position monitoring unit 24 to be adjusted after mounting of the door installation, as will be detailed more fully with respect to FIGS. 5, 7 and 8. The opposite end of the control arm 46 is pivotally connected with respect to the remaining portion of the unit 24 and is operably connected with the switch 28 in a manner to be discussed hereinafter.

Figure 3:
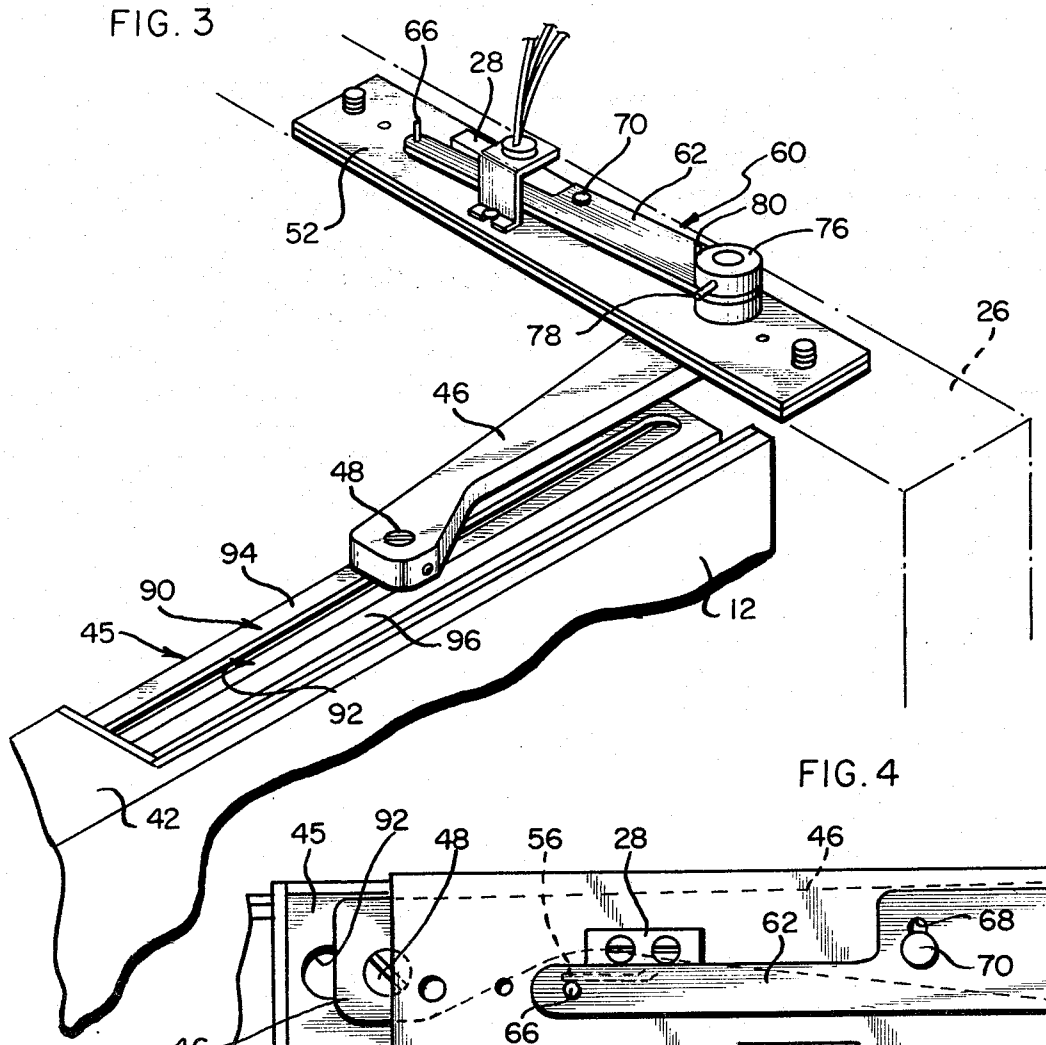
FIG. 3 is a perspective view of the door positioning monitoring arrangement of the present invention, with the control arm attached to the door, and the casing for the portion affixed to the door frame header removed.

With continued reference to FIG. 3, the header portion 26 of the door frame is shown in dotted outline, and mounted thereto is the functional portion of the monitoring unit 24 to which the end of the control arm 46 is pivotally connected. This portion of the monitoring unit 24 normally includes a housing 50, FIG. 5, carried by a base plate 52, but for purposes of illustration the housing 50 has been removed in FIG. 3. Also, looking to FIG. 5, it should be noted that the entire functional portion of the monitoring unit 24 is contained and concealed within the metal header portion 26, access thereto being precluded by a panel or plate 54, which also has been omitted from FIG. 3 for purposes of illustration. Returning to FIG. 3, and with reference to FIG. 6, it can be seen that the functional portion of the monitoring unit 24 includes the base plate assembly 52, upon which is mounted the circuit component 28 in the form of a conventional switch having a spring biased operating arm 56, (best seen in FIG. 6). Movement of the operating arm 56 effects operation of the switch 28 to and from the conditions as is shown in FIG. 2. Also carried by the base plate 52 is an actuator arrangement designated generally 60 which forms the mechanical interconnection between the control arm 46 and the switch 28.

Figures 6, 7:
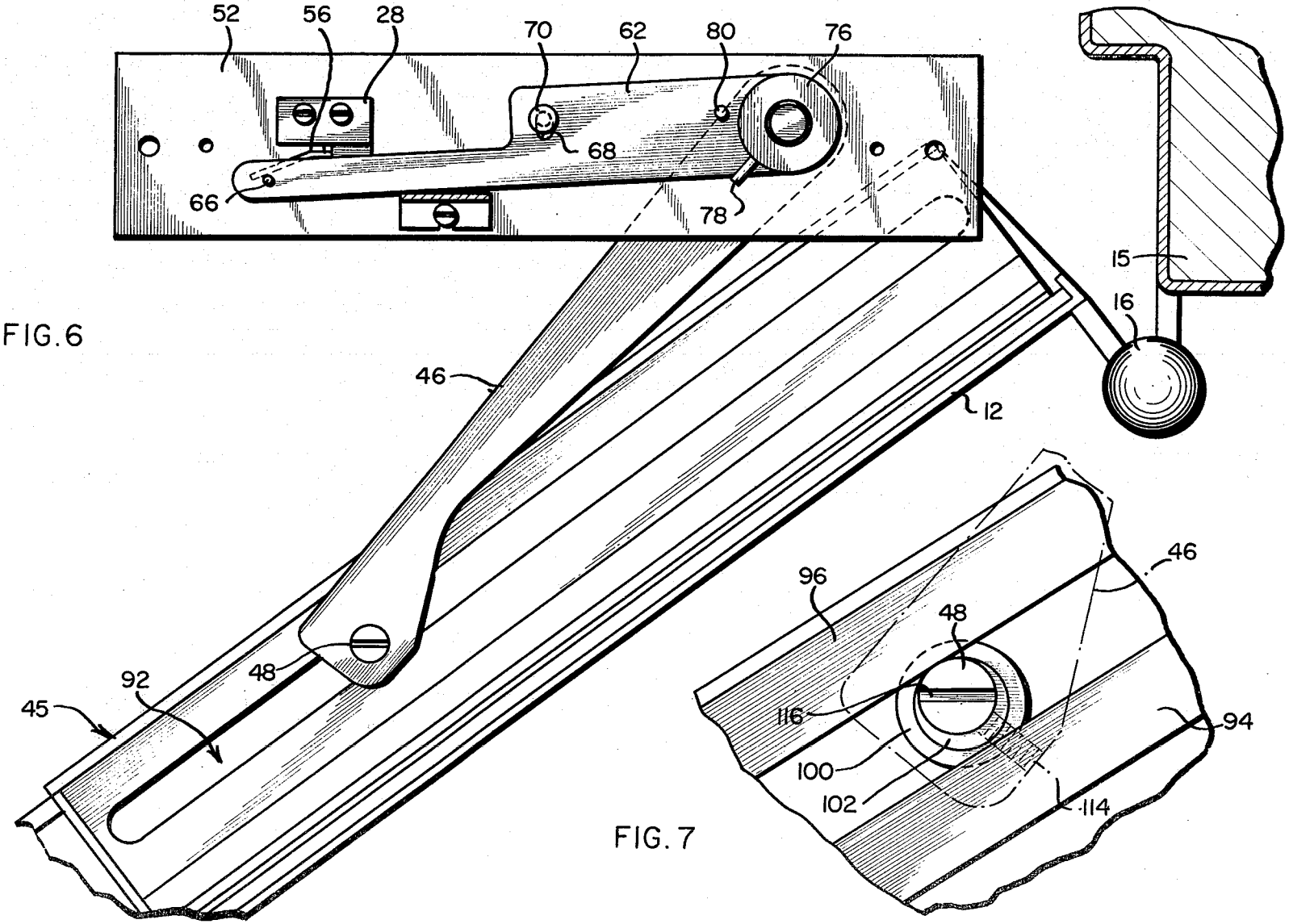
FIG. 6 is a top plan view of the door position monitoring arrangement of the present invention with the door in the open condition.
FIG. 7 is a partial view of the adjustment means used to attain a fine degree of adjustment in the operation of the unit when in the fully assembled condition.
Figure 8:
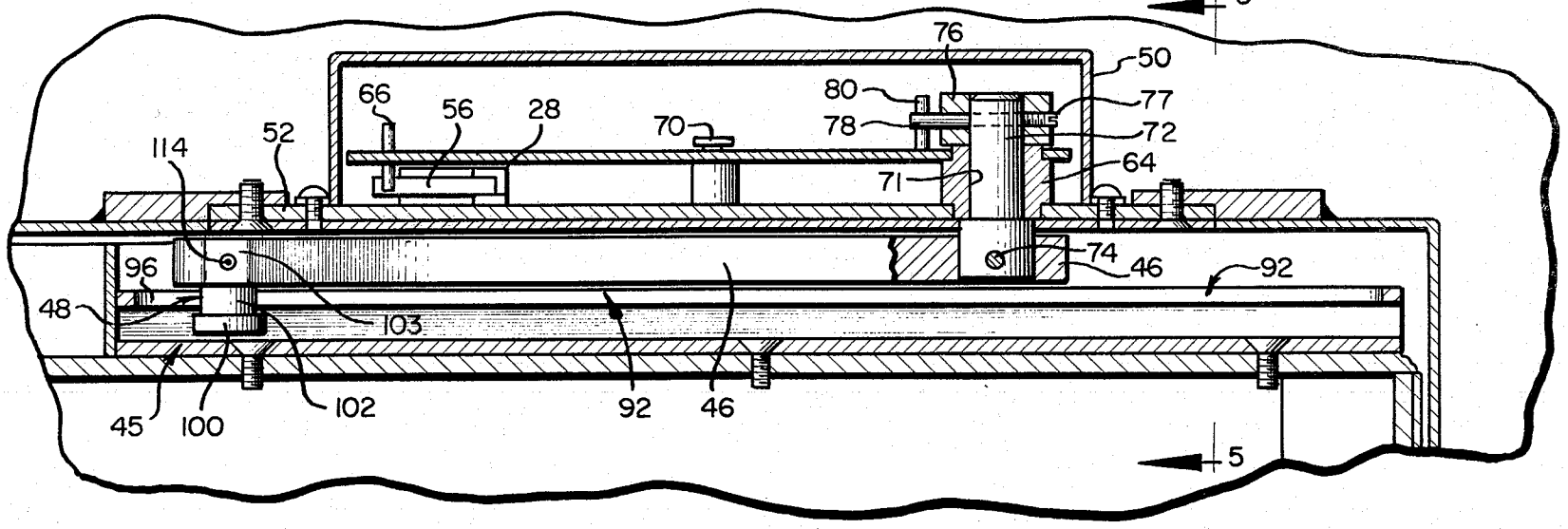
FIG. 8 is a sectional view illustrating the door positioning arrangement for the present invention mounted to a door assembly with the door in the closed position.

Actuator arrangement 60 is comprised primarily of a lever arm 62 which is pivotally mounted with respect to the base member 52 on a bearing block 64, as seen in FIG. 8. The lever arm 62 includes a pin 66 at the free end thereof which is engaged against the operating arm 56 of the switch 28. In addition, the lever arm 62 also includes a slot 68 engaged over a pin member 70 which defines the limits of pivotal movement of the arm 62. With reference to FIG. 8, it should be noted that the bearing block 64 has a central aperture 71 in which there is rotatably disposed a shaft member 72, which shaft member 72 fixedly is connected to the operating arm 46 by cross pin 74. Disposed on the upper end of the shaft 72 is an actuator collar 76, the position of the collar 76 on shaft member 72 being determined by a set screw 77, with the collar 76 including a generally horizontally extending pin member 78. The mounting of the shaft 72 with respect to the bearing block 64 is a rotative one, such that the control arm 46, shaft 72, and correspondingly, actuator collar 76 and pin 78 all pivot together. The lever arm 62 includes an additional upstanding pin member 80 disposed in the path of movement of the pin 78 mounted to the actuator collar. Accordingly, as the collar 76 rotates, pin 78 will engage pin 80, imparting clockwise movement to the lever arm 62 which in turn causes the pin 66 on the opposite end of said lever arm 62 to depress spring biased operating arm 56 of switch 28. Thus, it can be seen that when pin 78 is not engaged with pin 80, the spring biased operating arm 56 will tend to urge the lever arm 62 to the condition as shown in FIG. 6, which constitutes the normal biased condition for the switch 28.

Attention is now directed to the construction of the track assembly 45, which is best understood with reference to FIGS. 5 and 8. In this regard, the track assembly 45 includes a mounting plate 84 having a pair of spaced, supports 86 and 88 extending longitudinally along the length thereof. Affixed to the upper surfaces of the supports 86 and 88, is a slotted member 90, with the slot 92 therein in effect defining a pair of spaced rails 94 and 96.

Figure 4:
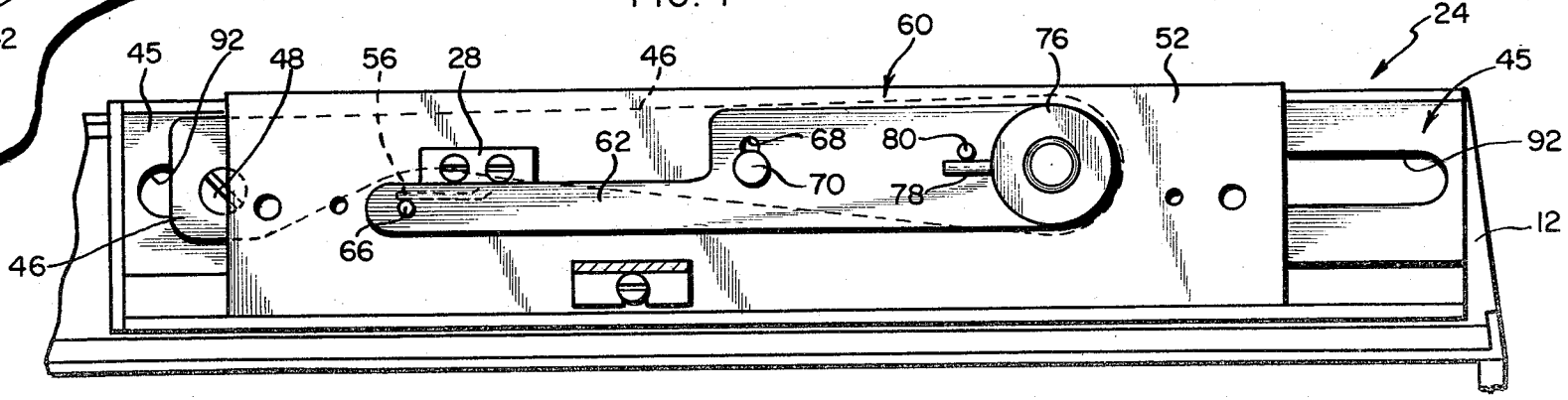
FIG. 4 is a top plan view of the door positioning apparatus of FIG. 3, with the door in fully closed condition.

The pin member 48 which slidably connects the operating arm 46 to the track means, includes an enlarged head portin 100 that is received beneath the rails 94 and 96, and an intermediate portion 102 that is of an eccentric construction and is disposed between the edge surfaces of the rails 94 and 96. The dimension of the eccentric portion 102 is such that it is substantially in engagement with said edge surfaces at all times. As will be detailed more fully after the general description of the operation of the monitoring unit 24 to follow, the eccentric portion 102 enables fine adjustment of the operation of the switch 28, once the unit 24 is mounted in operative position. The general operation of the door position monitoring unit 24 in conjunction with the overall door security installation of FIGS. 1 and 2 will now be considered. In this regard, FIGS. 3 and 6 illustrate the condition of unit 24 when the door 12 is open, while FIG. 4 shows the fully closed condition for unit 24. Accordingly, when the door 12 is in the closed condition, the monitoring switch 20 associated with the lock unit 18 will be operated to the door closed condition as shown in dotted position in FIG. 2. Correspondingly, with respect to secondary monitoring unit 24, the control arm 46 will extend longitudinally of the base member 52 with the guide pin 48 disposed in the left-hand portion of slot 92 as viewed. At the factory, the position of the actuator collar 76 is set by use of the set screw 77, so that pins 78 and 80 engage when the control arm 46 is in the illustrated position. This engagement will rotate the lever arm 62 to its clock-wise most position, thereby depressing the actuator arm 56 for switch 28, operating switch 28 to the door-closed position, as shown in dotted line in FIG. 2. Thus, both switches 20 and 28 will be in the door-closed position and the lamp 32 indicating this condition will be energized. As the door 12 begins opening movement, see FIG. 6, the base member 54 which is mounted to the door frame header 26 remains stationary, and the guide pin member 48 for control arm 46 slides along the slot 92 of track means 45, with the control arm 46 pivoting a counter clock-wise direction as viewed. This counter-clockwise movement of the control arm 46 is transmitted directly to the actuator collar 76 by the pivot pin or shaft 72, and will cause the pin 78 to move away from the lever arm pin 80. Since the lever arm 62 is being biased by the spring actuator arm 56 in the direction as indicated by arrow 106, said lever arm 62 will tend to follow the actuator collar pin 78 until movement in the direction 106 is precluded by the stop means provided by slot 68 and stop pin 70 and switch 28 is biased to the door-open condition. Thus, if an inmate tried to override the lock 18 and switch 20 associated therewith, the secondary monitoring unit 24 would preclude the issuance of a false "door secure" signal at the panel 22. More specifically, due to the sensitivity of the unit 24, switch 28 will remain in the door open condition and will not be operated to the door closed condition until the door 12 reaches the fully closed position, or is within less than two degrees (2°) of said position. Accordingly, at the point in the path of movement of door 12 wherein switch 28 is operated to the door closed condition, there does not exist a sufficient opening or gap at the jamb 15 to permit an inmate to tamper with lock 18 and switch 20. As can be seen from FIG. 2, even if the switch 20 were manually depressed to the door closed condition, the switch 28 would remain in the door open condition, thereby giving the proper signal at the control panel that the door 12 was not secured.

Figure 9:
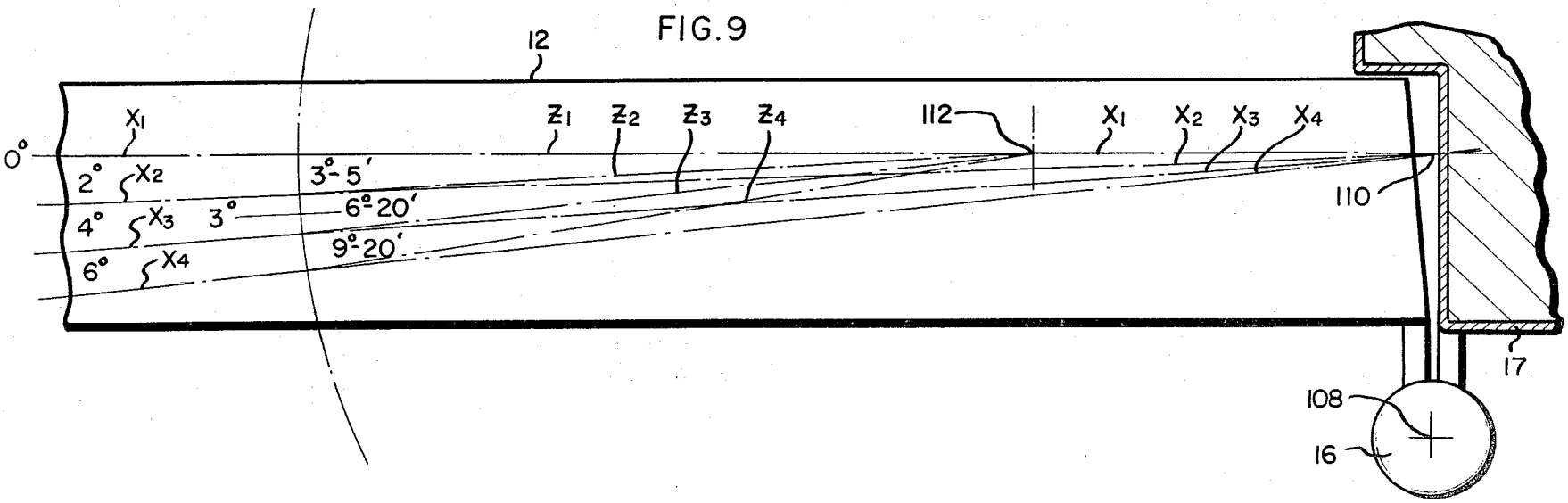
FIG. 9 is a plan view of the door and hinge construction and illustrates graphically the improved performance attained with the present invention.

As was discussed previously, one of the primary features of the door position monitoring unit 24 of the present invention is its increased sensitivity to door movement. A further discussion in this regard will now be had with regard to FIG. 9 to which attention is directed, which figure illustrates graphically a comparison of door movement to the degree of actuator movement attained by the monitoring unit 24 of the present invention. More specifically, in FIG. 9, there is shown the door 12, the jamb 17 of the door frame, and a hinge 16, which hinge provides the pivotal mounting for the door about an axis 108. Superimposed on FIG. 9 are a series of datum lines, one set $X_1$–$X_4$ corresponding to door movement along the center line of track 45 and about a datum axis 110 in line with the hinge axis 108. There is also provided a second set of datum lines $Z_1$–$Z_4$ corresponding to the rotational movement of the control arm 46 about the axis 112 of the pivot pin or shaft 72. Accordingly, as the door 12 moves through an initial two degree (2°) arc from $X_1$–$X_2$ control arm 46 must move through an arc $Z_1$–$Z_2$, which corresponds to an arc of approximately three degrees - five minutes (3°–5′). As door movement continues to positions $X_3$ and $X_4$ the door movement totals arcs of four degrees (4°) and six degrees (6°) respectively. Correspondingly, the control arm 46 moves to datum lines $Z_3$ and $Z_4$ which produce total arcs of movement of six degrees—twenty minutes (6°–20′) and nine degrees—twenty minutes (9°–20′) respectively. Thus, it can be seen that with the door position monitoring unit 24 of the present invention, the ratio of door movement to actuator movement available at the actuator collar 76 to effect switch operation is approximately 1.55:1, as compared to a 1:1 ratio attained with a monitoring unit of the prior art type discussed above, wherein said prior art unit is operated as a result of the pivotal movement occurring at the pivot axis for the hinges 16. In practice, it has been found that this increased sensitivity is sufficient to attain operation of conventional switches from the door open condition to the door closed condition within a relatively few degrees of movement of the door, while with the aforementioned prior art designs for monitoring units, the same degree of door movement would produce insufficient operational rotation about the hinge axis to attain the desired switch operation.

With reference to FIGS. 7 and 8 the purpose for and function of the eccentric portion 102 on the guide pin 48 will now be considered. It must be kept in mind, that while approximate adjustment of the unit 24 will be done at the factory, it is important that the operational features of the unit 24 be "fine tuned" once the monitoring unit is mounted in an actual door installation. In this regard, as can be appreciated from the above discussion it is extremely desirable that the actuator pin 78 and the lever arm pin 80 engage to effect operation of the switch 28 to the door closed condition only when the door is in the fully closed position, and that pins 78 and 80 disengage to produce the door open condition for the switch 28 as soon as the door 12 starts to move from the fully closed position. Due to manufacturing tolerances, and other factors, such as slight variations in alignment that may occur during installation, the optimum operating conditions for the unit 24 can be attained only when the unit is mounted in a door installation, and the switch 28 wired to the control panel 22. To effect this "fine tuning" of the unit 24, the guide pin 48 is rotatably adjustable with respect to the arm 46. Looking to FIG. 8, it can be seen that the control arm 46 is received over a portion 103 of the slide pin 98 which is disposed immediately above the eccentric portion 102. The relative rotational position of the slide or guide pin 48 with respect to the control arm, is fixed by a set screw 114. As such, the set screw 114 can be loosened and the slide or guide pin 48 rotated to a desired position, with the set screw then being re-engaged to fix and maintain the desired position. It should be noted further, that the eccentric portion 102 of the guide pin 48 is disposed between the parallel inner edges of the rails 94 and 96 which defined the track slot 92, and that this engagement is relatively close, with only a sufficient degree of clearance being provided to enable the pin 48 to slide freely with respect to the rail. The pin 48 is also provided with a screwdriver slot 116 in the upper surface thereof to permit a screwdriver or similar tool to be engaged with said slot and the pin 48 rotated relative to the rails 94 and 96 as well as the control arm 46.

Accordingly, after installation of the unit 24 and connection thereof with the control panel 22, if it is determined that further adjustment is necessary, there is no need to dismantle the unit 24 as can be "fine tuned" in place. In this regard, the set screw 114 is backed out and the pin 48 rotated. The rotation of the guide pin 48 causes the eccentric 102 to rotate relative to the edge of the slot 92, thereby producing a change in position of the control arm engaged pin portion 103 relative to the edges of the slot 92, which movement effects a slight pivotal movement of the control arm 46. Since the control arm 46 is coupled to the actuator collar 76 and the actuator pin 78 by the pivot pin or shaft 72, this adjustment of the control arm position will also adjust the point of engagement of said actuator pin 78 with the lever pin 80. Thus, it can be appreciated, that this arrangement permits the installer of the unit 24 to select the optimum position wherein the operation of the monitoring switch 28 is attained at the proper door position.

There are several additional features of the present invention which render it extremely desirable for use in security door installations. Initially, it should be noted that the switch 28 and the actuator means 60 are disposed entirely within the header portion 26 of the door frame, and as such are not accessible and subject to tampering. Further, when the door 12 is in the closed and locked position, the track 45 and control arm 46 are also concealed and rendered inaccessible. Thus, when the door 12 is closed, and the unit 24 is properly mounted it is not susceptible to tampering. Finally, it should also be noted that with the design of the present invention, the door 12 can be opened a full one hundred and eighty degrees (180°). The prior art monitoring designs referred to above, which operate about the door hinge, are limited with respect to the degree of door opening movement that can be accommodated.

The features of the invention discussed in the preceding paragraph are particularly advantageous in security door installations wherein the door is hinged to swing into the cell, rather than out of the cell as is the case with the installation 10 of FIG. 1. As can be appreciated, if the door 12 were mounted to swing inwardly, the hinges 16 would have to be on the interior of the cell. Thus, with the prior art types of monitors, as mentioned above, wherein actuator movement is attained about the hinge axis, and the switch is housed within a casing mounted to the surface of the door frame, a significant danger exists that the monitoring operation can be circumvented. More specifically, with the hinges on the inside of the cell, these prior art monitoring units would also have to be mounted on the cell interior, thus presenting an inmate with an opportunity to tamper with the monitoring unit at his leisure. By comparison, with the monitoring unit 24 as disclosed herein, if the door 12 were mounted to swing inwardly, the unit 24 would still be concealed within the door header 26, and are not accessible to an inmate.

There has thus been shown or described a preferred embodiment of the present invention, which provides a monitoring unit of increased sensitivity. The specific structural features of the varius elements illustrated and described above constitute a preferred form of the invention, and it is to be understood that it is not intended that the invention be specifically limited to the precise details of the illustrated embodiment. Applicant is well aware that his invention is capable of modification and variation by those skilled in the art, and as such, the claims appended hereto are intended to define the spirit and scope of this invention.

The invention is claimed as follows:

1. A door position monitoring assembly for a security door installation, comprising, track means for mounting with respect to a horizontal edge of a door and movable therewith; a circuit component mountable with respect to a stationary surface of the door installation, such as the door frame or the threshold, which surface extends generally parallel to said horizontal edge of door, said circuit component being capable of being operated to attain a first condition, and a second condition which can be detected by suitable circuit means; a control arm having one end thereof slidably connected to said track means, and being pivotally mounted proximate the other end thereof, such that movement of said door will produce pivotal movement of said control arm; and actuator means interconnecting said pivotally mounted end of the control arm and said circuit component such that when the door is open said circuit component will be in a first condition, with rotation of said control arm upon movement of the door to the substantially closed position, producing a second condition for said circuit component, with initial movement of the door away from the fully closed position producing pivotal movement of the control arm in an opposite direction permitting said circuit component to return to said first condition.

2. A door position monitoring assembly according to claim 1 wherein said circuit component is carried by a base member mounted to said stationary surface, and said pivotally mounted end of said control arm is mounted to said base member.

3. A door position monitoring assembly according to claim 2, wherein said actuator means includes lever means rotatably mounted with respect to said base member and operably associated with said circuit component for producing a change in the condition thereof, said actuator means further including operating means associated with said control arm and said lever means, such that said lever means is operated to attain said second condition for the circuit component, only when said door is in the substantially closed position.

4. A door position monitoring assembly according to claim 3, wherein said operating means includes, a collar rotatably mounted with respect to said base member and connected to said control arm for movement therewith, first projecting means on said collar, and second projecting means on said lever means, which projecting means will be engaged when said door is moved to the substantially closed position, said engagement producing pivotal movement of said lever means to a first position for operating said circuit component to the second condition, with initial opening movement of said door away from the fully closed condition disengaging said projecting means, with said lever means being biased to a second position and said circuit component attaining said first condition.

5. A door positioning monitoring assembly according to claim 3, wherein said circuit component includes a spring biased member engaged with said lever means, tending to bias said lever arm to said second position, with movement of said spring biased member producing said change in condition of said circuit component.

6. A door position monitoring assembly according to claim 1, wherein said circuit component is a switch.

7. A door position monitoring assembly according to claim 1, wherein said control arm is connected to said track means by an adjustable connection which permits the relative position of the control arm with respect to the track means and correspondingly the door to which the track means is mounted, to be varied slightly even though the door position monitoring assembly is in the mounted, fully assembled condition, such that the fine adjustment of the operation thereof may be attained to insure that the actuator means will operate the circuit component to produce the second condition only when the door attains the fuly closed condition.

8. A door position monitoring assembly according to claim 7, wherein said track means includes a pair of spaced rails, and said control arm is slidably connected to said track means by a pin member, said pin member providing said adjustable connection and including a first, enlarged portion disposed beneath said rails, and a second, eccentric portion disposed intermediate said rails, said pin member being adjustably connected to said control arm so that its relative, rotative disposition with respect thereto may be varied, and a selected disposition fixed, with said adjustment of the pin means altering the relative disposition of the eccentric portion thereof with respect to the rails, producing a change in the relative position of the control arm with respect to the entire track means for any given position of the door.

9. A monitoring system for a security door installation comprising: lock means for said door, including primary monitoring means comprised of a first switch biased to a first condition and responsive to the door position, and being operated to a second condition, when the door is in the closed position; and secondary door position monitoring means, including a second switch normally biased to a first condition and responsive to the door position, and being operated to a second condition, when the door is in the closed position; and secondary, door position monitoring means, including a second switch normally biased to a first condition and responsive to door position for operation to a second condition when the door is in the fully closed position; and a control panel, with said switches being connected in series with said control panel, such that only when both said switches are in said second condition, will a signal corresponding to a door closed condition be given; said secondary door position monitoring means comprising: track means for mounting with respect to a horizontal edge of a door and movable therewith, a base member mountable with respect to a stationary surface of the door frame and having said second switch mounted thereon; a control arm having one end thereof slidably connected to said track means, and being pivotally connected to said base member proximate the other end thereof, such that movement of said door will produce pivotal movement of said control arm; and actuator means interconnecting said pivotally mounted end of the control arm and said second switch such that rotation of said control arm upon movement of the door to the fully closed position, will produce said second condition for said second switch with initial movement of the door away from the fully closed position producing pivotal movement of the control arm in an opposite direction to attain said first, biased condition for said switch.

10. A monitoring system according to claim 9 wherein said actuator means includes lever means rotatably mounted with respect to said base member and operably associated with said second switch for producing a change in the condition thereof, said actuator means further including operating means associated with said control arm and said lever means, such that said lever means is operated to attain said second condition for the second switch, only when said door is in the substantially closed position.

11. A monitoring system according to claim 10, wherein said operating means includes, a collar rotatably mounted with respect to said base member and connected to said control arm for movement therewith, first projecting means on said collar, and second projecting means on said lever arm, which projecting means will be engaged when said door is moved to the fully closed position, said engagement producing pivotal movement of said lever arm to a first position for operating said switch to the second condition, with initial opening movement of said door away from the fully closed condition disengaging said projecting means, with said lever being biased to a second position and said switch attaining said first, normally biased condition.

12. A monitoring system according to claim 10, wherein said second switch includes a spring biased member engaged with said lever arm, tending to bias said lever arm to said second position, with movement of said spring biased member producing said change in condition of said switch.

13. A monitoring system according to claim 9, wherein said control arm is connected to said track means by an adjustable connection which permits the relative position of the control arm with respect to the track means and correspondingly the door to which the track means is mounted, to be varied slightly even though the door position monitoring assembly is in the mounted, fully assembled condition, such that the fine adjustment of the operation thereof may be attained to insure that the actuator means will operate the switch to produce the second condition only when the door attains the fully closed condition.

14. A monitoring system according to claim 13, wherein said track means includes a pair of spaced rails, and said control arm is slidably connected to said track means by a pin member, said pin member providing said adjustable connection and including a first, enlarged portion disposed beneath said rails, and a second, eccentric portion disposed intermediate said rails, said pin member being adjustably connected to said control arm so that its relative, rotative disposition may be varied and a selected disposition fixed, with said adjustment of the pin means altering the relative disposition of the eccentric portion thereof with respect to the rails, producing a change in the relative position of the control arm with respect to the entire track means for any given position of the door.

15. A monitoring system according to claim 9, wherein said control panel includes first indicating means corresponding to a door-open position, and second indicating means corresponding to a door-closed condition, said first and second switches being wired in circuit with said first and second indicating means such that said second indicating means will be energized only when both said first and second switches are operated to the second condition.

16. A door position monitoring assembly for a security door installation comprising: track means for mounting with respect to a horizontal edge of a door and movable therewith, said track means including a pair of spaced rails; a circuit component carried by a stationary portion of the door installation; a control arm having one end thereof slidably connected to said track means, and the other end thereof pivotally connected with respect to said stationary portion of the door installation; actuator means interconnecting said control arm and said circuit component, such that movement of the door will produce pivotal movement of the control arm, which pivotal movement is transmitted to said actuator means for operation of said circuit component; and said first end of the control arm being connected to said track means by a pin arrangement includes a first, enlarged portion disposed beneath said rails, and a second, eccentric portion disposed intermediate said rails, said pin being rotatably mounted with respect to said control arm and said track means rails, and capable of having its relative position with respect thereto fixed, such that by altering the relative disposition of said pin means and the eccentric portion thereof with respect to said rails, the relative angular relationship of the control arm with respect to said track means can be varied for any given position of the door, thereby permitting the fine adjustment of said door position monitoring assembly even though said assembly is in the fully mounted condition, such that the operation of the actuator means affected by said control arm can be adjusted so that the circuit component is operated from a first condition to a second condition, only as the door reaches the fully closed position.

17. A door position monitoring assembly according to claim 16, wherein said actuator means includes lever means rotatably mounted with respect to a base member upon which said circuit component is mounted, and said lever means being operably associated with said circuit component for producing a change in the condition thereof, said actuator means further including operating means associated with said control arm and said lever means, such that said lever means is operated to attain said second condition for the circuit component, only when said door is in the fully closed position.

18. A door positioning monitoring assembly according to claim 17 wherein said circuit component includes a spring biased member engaged with said lever means, tending to bias said lever arm to said second position, with movement of said spring biased member producing said change in condition of said circuit component.

19. In combination, a security door installation, including a door frame, a door member, and hinge means mounting the door to the door frame for pivotal movement about the hinge means axis, and a monitoring system for said door, said system including a door position monitor comprising a track mounted to a horizontal edge of the door, a base member mounted to a stationary portion of the door frame, a circuit component carried by said base member, a control arm having one end thereof slidably connected to said track means and the other end pivotally connected to said base member at a location spaced from the hinge means axis, and actuator means interconnecting said control arm and said circuit component such that movement of the door will produce pivotal movement of said control arm, which pivotal movement is transmitted by said actuator means to said circuit component for operation thereof in response to door movement, with pivotal mounting of said control arm remote from the hinge axis produce a ratio of control arm movement to door movement that is greater than 1:1.

20. The combination according to claim 19 wherein said control arm is connected to said track means by an adjustable connection which permits the relative position of the control arm with respect to the track means and correspondingly the door to which the track means is mounted, to be varied slightly even though the door position monitoring assembly is in the mounted, fully assembled condition, such that the fine adjustment of the operation thereof may be attained to insure that the actuator means will operate the circuit component to produce a change in condition thereof only when the door attains the fully closed condition.

21. The combination according to claim 19, wherein said circuit component is a switch, which is normally biased to a first conditon, and is operated to a second condition only when said door is moved to the fully closed condition.

22. The combination according to claim 21 including at least one additional door position monitor, including a switch component operable from a first condition to a second condition upon the door attaining the door closed position, said door position monitors switches being wired in circuit with a control panel and door-open and door-closed indicator means thereon such that a door closed indication is given ony when both said switches are in the second condition.

23. The combination according to claim 19, wherein the base member, circuit component and actuator means are housed within the door frame.

24. In combination, a security door installation, including a door frame, a door member, lock means and hinge means mounting the door to the door frame for pivotal movement about the hinge means axis, and a monitoring system for said door, said system including first monitoring means associated with said lock means for providing an indication when the door is in the closed position, and second door position monitoring means housed within the door frame and including means for sensing when the door is in the closed position and providing an indication thereof, said second door position monitoring means being inaccessible when the door is in the closed and locked position, said first and second monitoring means being connectable with a control panel, or the like, to provide an indication that the door is in the door closed position, only when both said monitoring means senses the door closed position.

25. The combination according to claim 24, wherein said second door position monitoring means comprises track means mounted to a horizontal edge of the door, a base member mounted to a stationary portion of the door frame, a circuit component carried by said base member, a control arm having one end thereof slidably connected to said track means and the other end pivotally connected to said base member at a location spaced from the hinge axis, and actuator means interconnecting said control arm and said circuit component such that movement of the door will produce pivotal movement of said control arm, which pivotal movement is transmitted by said actuator means to said circuit component for operation thereof in response to door movement.

26. The combination according to claim 25 wherein said control arm is connected to said track means by an adjustable connection which permits the relative position of the control arm with respect to the track means and correspondingly the door to which the track means is mounted, to be varied slightly even though the door position monitoring assembly is in the mounted, fully assembled condition, such that the fine adjustment of the operation thereof may be attained to insure that the actuator means will operate the circuit component to produce a change in condition thereof only when the door attains the fully closed condition.

27. The combination according to claim 25, wherein said circuit component is a switch, which is normally biased to a first condition, and is operated to a second condition only when said door is moved to the fully closed position.

* * * * *

UNITED STATES PATENT AND TRADEMARK OFFICE

CERTIFICATE OF CORRECTION

PATENT NO. : 4,334,388

DATED : June 15, 1982

INVENTOR(S) : Raymond V. Kambic

It is certified that error appears in the above-identified patent and that said Letters Patent are hereby corrected as shown below:

Column 12, line 18, insert after "pin arrangement", --, which pin arrangement--.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*